US005432298A

United States Patent [19]

Thompson

[11] Patent Number: 5,432,298

[45] Date of Patent: Jul. 11, 1995

[54] APPARATUS FOR COVERING ELECTRICAL SOCKETS OR SWITCHES

[76] Inventor: Darrow D. Thompson, 3590 Colony Ct., Placerville, Calif. 95667

[21] Appl. No.: 134,599

[22] Filed: Oct. 12, 1993

[51] Int. Cl.[6] ..... B05C 11/00

[52] U.S. Cl. ..... 174/67; 16/DIG. 2; 118/505

[58] Field of Search ..... 174/67; 220/242, 3.4; 118/505; 16/DIG. 2; D8/14

[56] References Cited

U.S. PATENT DOCUMENTS 5,003,128 3/1991 Grondin ..... 174/67
5,063,872 11/1991 Maus et al. ..... 118/505
5,285,014 2/1994 Gilchrist ..... 174/67

*Primary Examiner*—Leo P. Picard
*Assistant Examiner*—David Tone
*Attorney, Agent, or Firm*—Thomas R. Lampe

[57] ABSTRACT

Apparatus for temporarily covering at least a portion of an electrical socket or switch having a housing includes a main panel and panels connected to the main panel and extending laterally from the main panel to form a recess. When a portion of the electrical socket or switch is positioned in the recess at least some of the panels are in clamping engagement with the electrical socket or switch. Accordion pleats integral with the main panel and panels connected to the main panel provide flexibility, enabling the apparatus to be connected to a variety of electrical sockets and switches.

11 Claims, 2 Drawing Sheets

APPARATUS FOR COVERING ELECTRICAL SOCKETS OR SWITCHES

TECHNICAL FIELD

This invention relates to apparatus for temporarily covering electrical sockets or switches. For example, the invention may be utilized to cover sockets and switches to protect them from paint, wall texturizer material, or wall paper paste.

BACKGROUND ART

Electrical sockets and switches should be protected from paint or other substances during construction or decoration activities. Not only can switches or plug sockets be rendered unsightly by paint or other materials being inadvertently applied thereto, but proper operation thereof can be interfered with if foreign substances are applied to the switch or socket in relatively large quantities.

These problems have been recognized and a number of schemes have been proposed to prevent such difficulties. For example, it is not uncommon to apply masking tape over switches and plug sockets. This approach is not always effective and removal of the tape when desired can be time consuming.

It is also known to cover switches or sockets with covers secured to the housings of the switches or sockets in some manner. For example, in the case of plug sockets, the cover may be secured thereto by projections extending into the socket. Alternatively, the covers may be secured in place by the screws normally utilized to attach a face plate to the housing. Such arrangements are generally switch or socket specific in that they can only be utilized with either sockets or switches, not both. Furthermore, prior art covers are often not even applicable for use with all of the various switch and socket housing configurations in common usage.

DISCLOSURE OF INVENTION

The present invention relates to apparatus for covering an electrical socket or switch which is characterized by its relative simplicity and low cost as well as by its applicability for use with a wide variety of sockets and switches. The cover apparatus may be applied or removed from the housing of the switch or socket quickly and efficiently.

The apparatus of the present invention includes a main panel for placement over a socket or switch housing. A first panel extends laterally from the main panel and a second panel extends laterally from the main panel in spaced opposition to the first panel.

A third panel extends laterally from the main panel between the first panel and the second panel.

A fourth panel extends laterally from the main panel between the first panel and the second panel, the fourth panel being in spaced opposition to the third panel. The panels defining a recess for receiving a socket or switch housing to cover the socket or switch.

Biasing means is provided for biasing at least two of the opposed panels into clamping engagement with the housing ends or sides of a socket or switch housing received in the recess to releasably maintain the apparatus in position on the socket or switch housing received in the recess.

The biasing means includes at least one flexible accordion pleat formed in the main panel and in at least two of the opposed panels.

Other features, advantages, and objects of the present invention will become apparent with reference to the following description and accompanying drawings.

MODES FOR CARRYING OUT THE INVENTION

Figure 1:
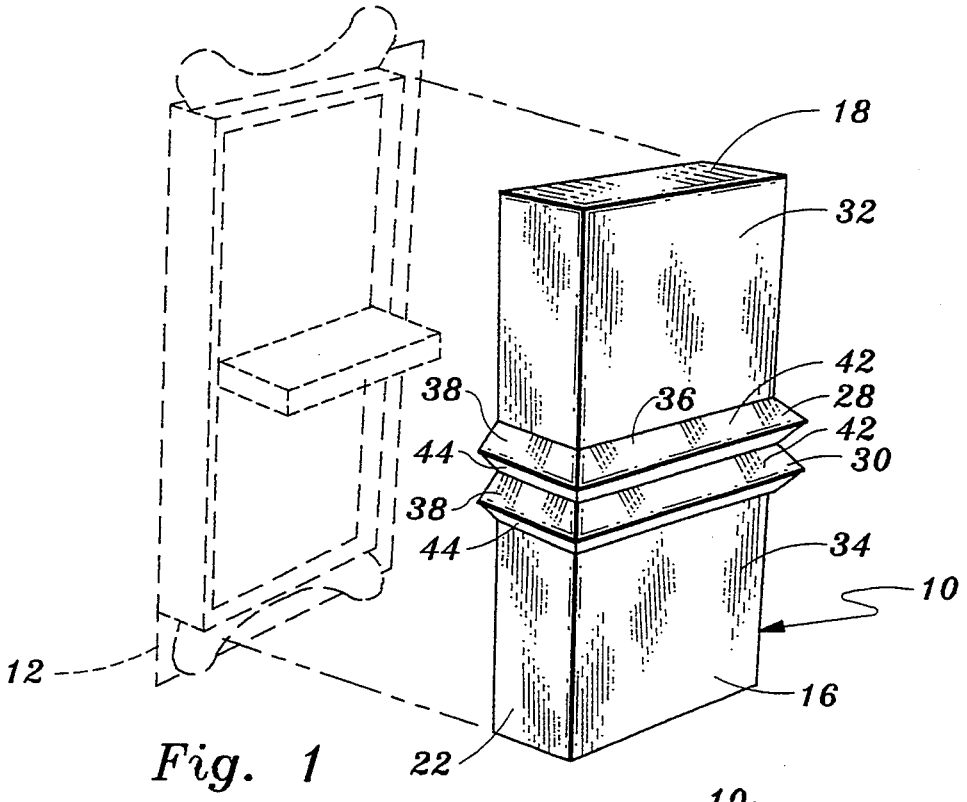
FIG. 1 is a perspective view of cover apparatus constructed in accordance with the teachings of the present invention prior to positioning over an electrical switch.
Figure 2:
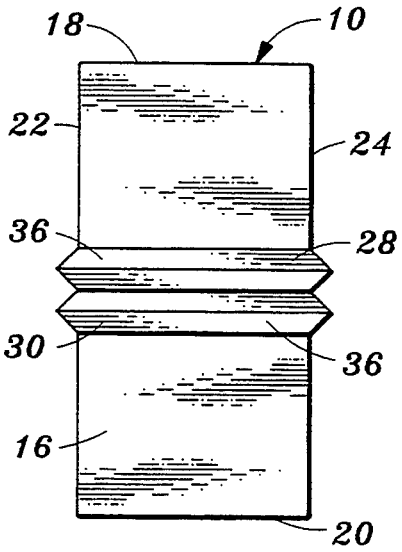
FIG. 2 is a front view of the apparatus.
Figure 3:
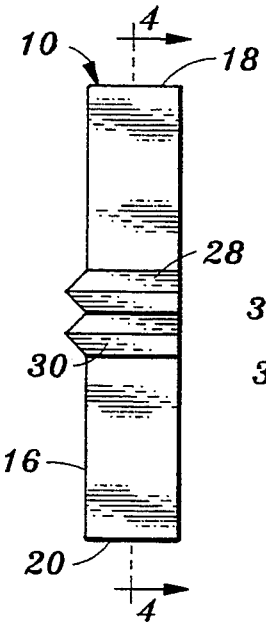
FIG. 3 is a side view of the apparatus.
Figure 4:
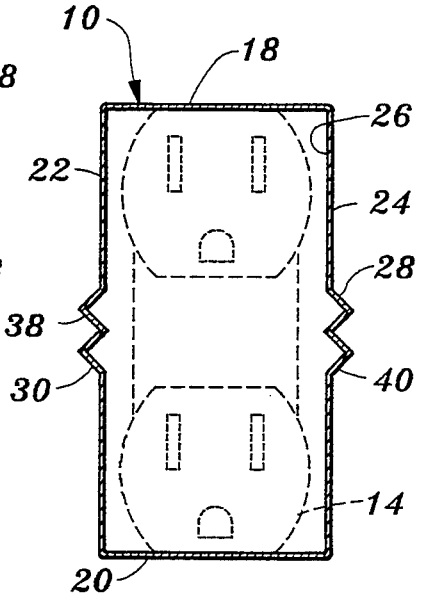
FIG. 4 is a cross-sectional view taken along the line 4—4 in FIG. 3 and illustrating the apparatus in place on the housing of a electrical socket shown in dash lines.
Figure 5:
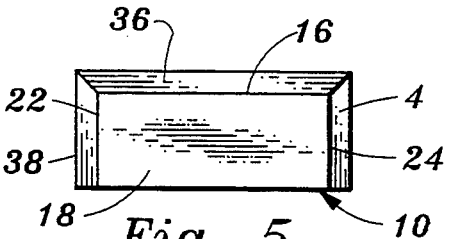
FIG. 5 is a top view of the apparatus.
Figure 6:
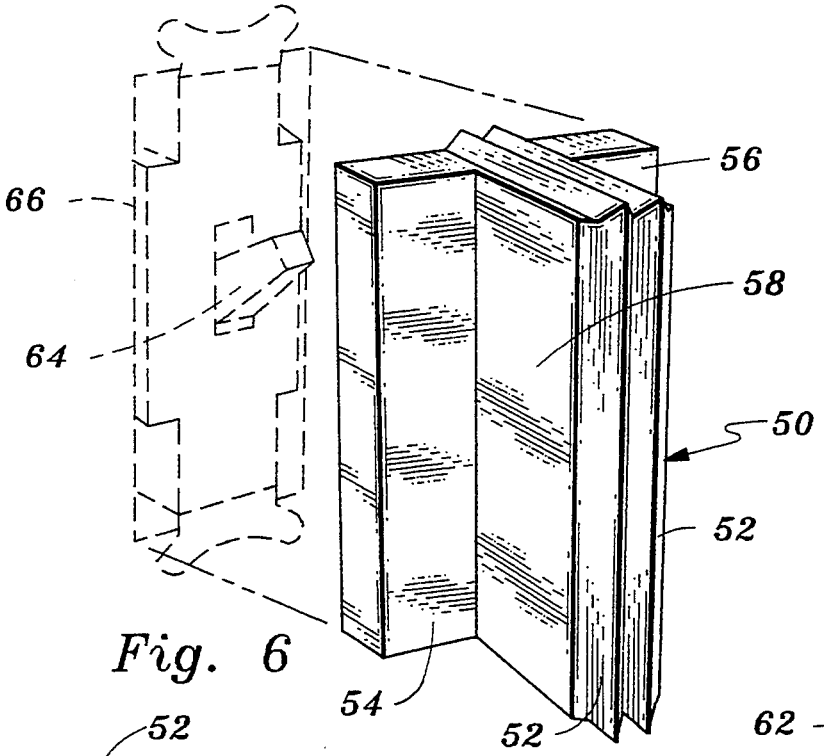
FIG. 6 is a perspective view of an alternative embodiment of the apparatus prior to placement over an electrical switch.
Figure 7:
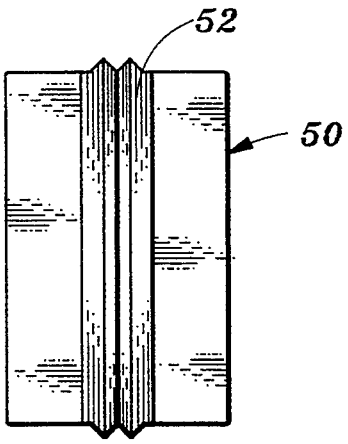
FIG. 7 is a front view of the alternative embodiment of the apparatus.
Figure 8:
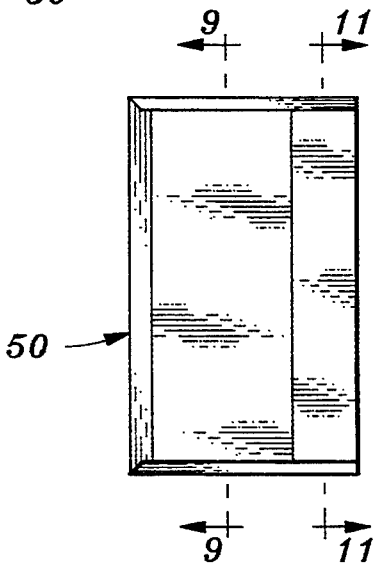
FIG. 8 is a right side view of the alternative embodiment of the apparatus.
Figure 9:
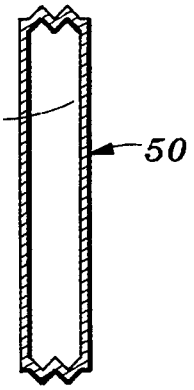
FIG. 9 is a sectional view of the alternative embodiment of the apparatus taken along the line 9—9 of FIG. 8.
Figure 10:
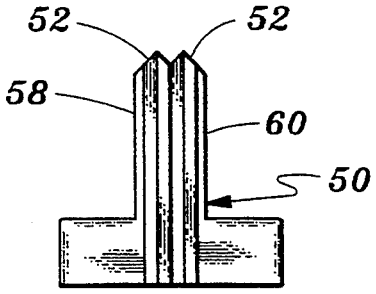
FIG. 10 is a top view of the alternative embodiment of the apparatus.
Figure 11:
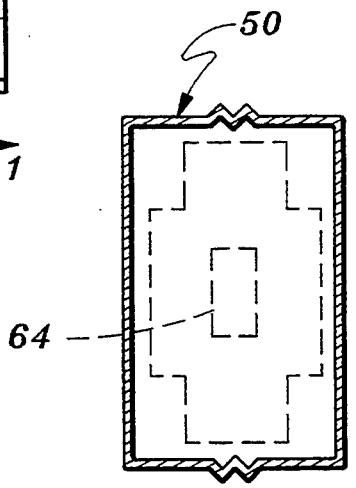
FIG. 11 is a cross-sectional view taken along the line 11—11 in FIG. 8.

Referring now to FIGS. 1–5, apparatus constructed in accordance with the teachings of the present invention is designated by reference numeral 10. Apparatus 10 is in the form of a cover which is to be placed over an electrical socket or switch and temporarily connected to the housing thereof. For example, FIG. 1 illustrates the apparatus 10 being applied to a conventional slide-type, variable electrical switch having a housing 12. FIG. 4 shows the apparatus 10 in position over the housing 14 of a conventional electrical socket. The apparatus 10 may be utilized with virtually all standard household electrical switches and sockets.

The apparatus includes a main panel 16 for placement over a socket or switch, the main panel having a dimension generally corresponding to the outer periphery of the socket or switch housing.

A first panel 18 extends laterally from the main panel as does a second panel 20 in spaced opposition to the first panel.

A third panel 22 extends laterally from the main panel between the first panel and the second panel.

A fourth panel 24 extends laterally from main panel 16 between the first panel 18 and second panel 20, the fourth panel being in spaced opposition to the third panel. Panels 16, 18, 20, 22, and 24 define a recess 26 for receiving a socket or switch housing, such as housings 12, 14.

Biasing means is provided for biasing at least two of the opposed panels into clamping engagement with the housing ends or sides of a socket or switch housing received in recess 26 to releasably maintain the apparatus 10 in position on the socket or switch housing received in the recess. In the arrangement illustrated in FIGS. 1–5, the biasing means is in the form of two integral, flexible accordion pleats 28, 30 formed in main panel 16 and dividing the main panel into two spaced generally planar main panel sections 32, 34 disposed on opposite sides of the accordion pleats.

Each flexible accordion pleat includes a central section 36 and two end accordion pleat sections 38, 40 spaced from one another, contiguous with the central accordion pleat section, and extending substantially at right angles to the central accordion pleat section. All of the panels 16, 18, 20, 22, and 24 and the flexible accordion pleats are preferably of integral molded plastic construction, formed, for example, of high density polyethylene. All of the panels in the disclosed embodiment and the accordion pleats themselves have a degree of flexibility due to the fact that the apparatus is of relative thin-walled construction, e.g. 0.035 inches.

Each flexible accordion pleat 28, 30 includes two straight pleat panels 42, 44 extending outwardly from the main panel. The pleat panels 42, 44 join at a line of convergence. The end accordion pleat sections 38, 40 are similarly configured.

Panels 18, 20, 22, and 24 are interconnected and define a continuous skirt extending from the outer periphery of the main panel. The skirt is dimensioned so that it clampingly engages the ends and sides of the housing received in recess 26. In FIG. 4, first panel 18 is in engagement with a first housing end, second panel 20 is in engagement with a second housing end, and third and fourth panels 22, 24 are engaged with two spaced, opposed housing sides interconnecting the first housing end and the second housing end.

It will be appreciated that the apparatus 10 must be properly dimensioned to accommodate the housing to which it is applied and frictionally engage the housing. With the present invention, the apparatus 10 may be made available in one size and fit most commonly employed electrical socket outlets and electrical switch housings. More specifically, the distance between the inner surfaces of first panel 18 and second panel 20 is preferably 2.592 inches and the distance between the interior surfaces of third panel 22 and fourth panel 24 is preferably 1.295 inches. The flexibility provided by accordion pleats 28, 30 will provide sufficient skirt panel flexibility to enable the skirt to be secured into frictional engagement with commonly employed conventional electrical switches and sockets. Of course, the dimensions of the apparatus can be modified as appropriate to accommodate switch or socket housings outside the conventional ranges.

The housing received in the recess 26 will be clamped between at least two of the opposed panels of the apparatus and may be readily attached to or detached from the housing. To further ensure a relatively tight fit between the housing and the apparatus along the entire length of the skirt, it is preferred that the corners defined by the panels be squared off.

Referring now to FIGS. 6 through 11, an alternative form of the apparatus, identified by reference numeral 50, is illustrated. This embodiment differs from that of FIG. 1–5 in that the central accordion pleat sections 52 of the pleats are located outwardly of the two spaced generally planar main panel sections 54, 56. Along with outwardly projecting panels 58, 60 the central accordion pleat sections of the two illustrated accordion pleats define an enlarged recess portion 62 which can accommodate a toggle switch 64 of switch 66. In this embodiment, the sides of the toggle switch are frictionally engaged by the interior surfaces of opposed panels 58, 60 connected to and extending laterally of the main panel to retain the apparatus 50 in place.

I claim:

1. Apparatus for covering at least a portion of an electrical socket or switch having a housing including a first housing end, a second housing end, and two spaced, opposed housing sides interconnecting the first housing end and second housing end, said apparatus comprising, in combination:

a main panel for placement over at least a portion of an electrical socket or switch;

a plurality of panels connected to and extending laterally from the main panel including a first panel connected to and extending laterally from the main panel, a second panel connected to and extending laterally from the main panel in spaced opposition to said first panel, a third panel connected to and extending laterally from the main panel between said first panel and said second panel, and a fourth panel connected to and extending laterally from the main panel between said first panel and said second panel, said fourth panel being in spaced opposition to said third panel, and said panels defining a recess for receiving at least a portion of a socket or switch to cover at least a portion of said electrical socket or switch; and biasing means for biasing at least two opposed panels of said apparatus into clamping engagement with at least a portion of an electrical socket or switch received in said recess to releasably maintain the apparatus in position on the electrical socket or switch, said biasing means including at least one flexible accordion pleat formed in said main panel and in at least two opposed panels.

2. The apparatus according to claim 1 wherein all of said panels and said at least one flexible accordion pleat are of integral molded plastic construction.

3. The apparatus according to claim 2 wherein said plastic is high density polyethylene.

4. The apparatus according to claim 1 wherein said at least one flexible accordion pleat comprises a central accordion pleat section and two end accordion pleat sections spaced from one another, contiguous with said central accordion pleat section, and extending substantially at right angles to said central accordion pleat section.

5. The apparatus according to claim 4 wherein said main panel includes two spaced main panel sections disposed on opposite sides of said at least one flexible accordion pleat, said central accordion pleat section being located outwardly of said two spaced main panel sections and at least partially defining an enlarged recess portion for accommodating a toggle switch, said enlarged recess portion being at least partially defined by two opposed panels clampingly engageable with said toggle switch.

6. The apparatus according to claim 1 wherein said biasing means comprises a plurality of parallel flexible accordion pleats.

7. The apparatus according to claim 1 wherein said at least one flexible accordion pleat includes two straight pleat panels extending outwardly from said main panel and wherein said two straight pleat panels join at a line of convergence.

8. The apparatus according to claim 1 wherein said first panel, said second panel, said third panel, and said fourth panel are interconnected and define a continuous skirt extending from the outer periphery of said main panel.

9. The apparatus according to claim 8 wherein said skirt is dimensioned so that it tightly engages the first housing end, the second housing end and the two spaced opposed housing sides of a socket or switch housing received in said recess.

10. The apparatus according to claim 9 wherein said skirt defines four spaced, squared-off interior corners.

11. The apparatus according to claim 1 wherein at least two of said opposed panels are flexible.

* * * * *